US005768710A

United States Patent [19]

Williams

[11] Patent Number: 5,768,710

[45] Date of Patent: Jun. 23, 1998

[54] WEIGHTED FINGER EXERCISE/ REHABILITATION GLOVE

[76] Inventor: James H. Williams, 18490 SE. Wood Haven La., Prestwick E, Tequesta, Fla. 33469

[21] Appl. No.: 718,685

[22] Filed: Sep. 24, 1996

[51] Int. Cl.[6] ..... A41D 19/00

[52] U.S. Cl. ..... 2/161.1; 2/160; 2/161.4; 2/163; 2/162

[58] Field of Search ..... 2/158, 159, 160, 2/161.1, 161.2, 161.3, 161.4, 161.5, 161.6, 161.7, 161.8, 162, 163, 164, 166, 167, 168, 169, 170

[56] References Cited

U.S. PATENT DOCUMENTS

| | | | |
|---|---|---|---|
| 889,397 | 6/1908 | O'Shaughnessy | 2/159 |
| 2,902,693 | 9/1959 | Wells | 2/158 |
| 3,290,695 | 12/1966 | Burtoff | 2/161.8 |
| 3,368,811 | 2/1968 | Finney | 2/159 X |
| 3,386,104 | 6/1968 | Casey | 2/161.6 X |
| 3,421,160 | 1/1969 | Domenico | 2/159 |
| 3,547,112 | 12/1970 | Courtney | 2/159 X |
| 3,838,853 | 10/1974 | Fredenhangen | 2/161.1 X |
| 4,247,097 | 1/1981 | Schwartz . | |
| 4,326,706 | 4/1982 | Guthrie et al. | 2/160 X |
| 4,330,120 | 5/1982 | Netti | 2/160 X |
| 4,371,983 | 2/1983 | Piotti | 2/160 X |
| 4,684,123 | 8/1987 | Fabry | 2/160 |
| 4,691,387 | 9/1987 | Lopez | 2/159 X |
| 4,911,433 | 3/1990 | Walker et al. | 2/161.1 X |
| 5,144,694 | 9/1992 | Da oud . | |
| 5,182,814 | 2/1993 | Christensen . | |
| 5,267,927 | 12/1993 | Catanzano . | |
| 5,316,294 | 5/1994 | Turangan | 2/159 X |
| 5,451,191 | 9/1995 | Beenken . | |
| 5,530,967 | 7/1996 | Cielo | 2/160 X |

*Primary Examiner*—C. D. Crowder
*Assistant Examiner*—Shirra L. Jenkins
*Attorney, Agent, or Firm*—McHale & Slavin, P.A.

[57] ABSTRACT

An exercise and rehabilitation device consisting of a weighted pair of gloves, each glove having a permanently affixed weighted section on the back-hand side of the glove and paired contoured weights which encircle the end of each individual finger and thumb sleeve. The digit sleeves are open ended to expose the individuals fingertips. A hook-and-pile attachment strip on the palm of the glove is operatively associated with a hook-and-pile covered cylindrical weight which can be detachably grasped by the wearer. A weighted wrist support strap detachably secures the glove to the individual's hand.

6 Claims, 1 Drawing Sheet

WEIGHTED FINGER EXERCISE/ REHABILITATION GLOVE

FIELD OF THE INVENTION

This invention relates to a weighted glove with individual finger separation which integrates weights into the body, wrist, palm, and individual finger portions of the glove.

BACKGROUND OF THE INVENTION

The need for a person to exercise the individual muscles of the hand arises in a variety of situations. Athletes often wish to increase their hand strength and dexterity, particularly the strength in each individual finger. This is true in sports such as golf or basketball where the individual strength of the player's fingers and hand can play a significant part in the success of each golf or basketball shot. Musicians such as guitarists and violinists also need to continually work on their hand strength, particularly the strength in each individual finger in order to properly depress the instrument strings. More generally, persons who have had their hands or arms injured and/or operated on need to perform rehabilitation exercises by lifting weights with their hands. Often the rigors of specifically allocating time during the day for such exercises discourages the activity altogether. Therefore ease and versatility of use is an important consideration for such exercise equipment.

U.S. Pat. No. 4,247,097 discloses a variable weight aerobic exercise glove which is shaped like a mitten. The glove has a pair of pockets on the back surface which incorporate weights, with one pocket overlying the wearer's wrist and the other overlying the wearer's hand. The glove also incorporates a loop in the palm for holding a cylindrical weight, and a wrist strap for securing the glove. The glove does not, however, incorporate any individualized weighting of the fingers. As a result, while some muscles of the hand and arm may be strengthened, the fingers relatively immobile with no individual weighting or flexibility. Also the loop on the palm area does not allow for quick interchangability of the weight contained therein.

Other devices allow for the individual rehabilitation and exercise of each finger, but without the convenience of a portable glove which can be worn during other activities such as aerobics. For instance, U.S. Pat. No. 5,451,191 discloses mechanism with a pivoting arm rest and a plurality of tensioned cables which are connected to finger harnesses. The cables are spring loaded to provide resistance to movements of the fingers, thereby strengthening the muscles of the hand and fingers. Such devices, while versatile in their ability to rehabilitate and exercise the various muscles of the hand, are complex, heavy, and generally meant to be used while sitting stationary on a supporting surface.

Accordingly, what is needed in the art is an exercise and rehabilitation device which can provide resistance to individual fingers and muscles of the hand, but which is simple, compact, and portable in its design. A glove with individually weighted fingers, thumb, and glove portions would serve this purpose and could be constructed durable enough to be used during other forms of exercise such as aerobics, jogging, or boxing. The glove device should also provide a quick and convenient way of adding or subtracting weight which would not require removing and re-donning the gloves. The glove device should be waterproof and have rubberized or plastic covered weights so that the glove can be washed and/or used during activities such as swimming.

SUMMARY OF THE INVENTION

The present invention provides a weighted exercise and rehabilitation glove with individualized finger and thumb sleeves. Each finger and thumb sleeve is half-length to expose the user's fingertips to retain fingertip dexterity and incorporates a weight along the top and bottom side of each finger. The back-hand side of the glove incorporates a single weight or alternatively a series of weighted flat bars which run parallel with the bones of the hand. Such an arrangement allows for lateral flexibility of the glove. Moreover, this back-hand side weight will be positioned away from the knuckles so that the weight cannot readily be used as a weapon.

The palm-side of the glove includes a strip of hook-and-pile type attachment material, one such brand known as VELCRO, which is used to affix a hook-and-pile covered cylindrical weight. The gloves are designed so that sequentially heavier weights which are also covered with hook-and-pile material are easily substituted, as needed, without having to remove the gloves. Similarly, the gloves might be used without any palm weight attached. A weighted band or strap is also included around the wrist area of each glove with a secure strap which incorporates both a snap and a hook-and-pile type attachment device. The weighted, sturdy strap will wrap around the entire wrist to prevent slippage of the glove during an exercise or rehabilitative activity.

Each of the incorporated weights incorporate smooth edges so as not to cut the glove material and/or the user's skin. The weights can be fixedly incorporated into the glove to prevent loss or injury to others during use. This feature is especially important when the device is used during vigorous exercising. Depending upon the activity, people who desire more weight can increase the poundage or size of the cylinder weight which attaches to the hook-and-pile patch in the palm.

The glove can be made from vinyl, leather, neoprene, nylon, or any other such durable material. Each finger sleeve will have elasticity along the side to ease in donning and removing the glove. Such elastic panels will also improve the flexibility and comfort of the glove while being worn. The glove will be constructed in many different sizes and weights to accommodate the needs of a variety of users. Various colors or patterns might be used to add to the "sporty" look and aesthetic appeal of the gloves.

It is therefore an object of the present invention to provide a exercise and rehabilitation glove with weighted hand and wrist portions, as well as individually weighted finger and thumb portions.

It is a related object of the present invention to provide an exercise and rehabilitation glove wherein such weights are permanently incorporated into the glove.

It is still a related object of the present invention to provide an exercise and rehabilitation glove with hemispherical weight sections encompassing the top and bottom of each finger and thumb, and weighted bars spaced apart across the back-hand portion of the glove for increased flexibility.

It is still another object of the present invention to provide an exercise and rehabilitation glove providing a hook-and-pile attachment section and a corresponding hook-and-pile covered cylindrical weight for attachment to the palm area.

It is yet another object of the present invention to provide an exercise and rehabilitation glove with an additional weighted wrist strap to securely hold the glove in place.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Although the invention has been described in terms of a specific embodiment, it will be readily apparent to those skilled in this art that various modifications, rearrangements and substitutions can be made without departing from the spirit of the invention. The scope of the invention is defined by the claims appended hereto.

Figure 1:
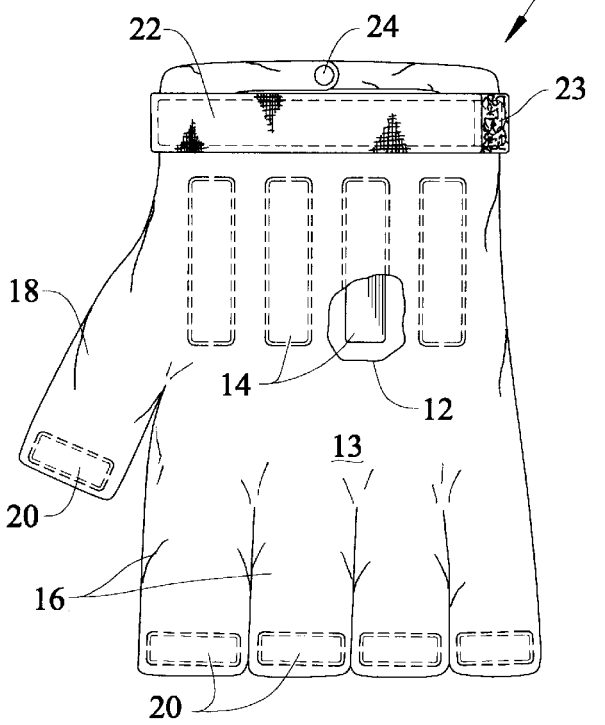
FIG. 1 shows a top view of the back-hand side of a weighted glove with the incorporated weight sections shown in fathom.

Referring now to FIG. 1, a top view of a glove 10 of the present invention is shown. A cutaway section 12 illustrates a series of flat weight bars 14, typically four, mounted in the material of the glove on the back-hand side 13 of the glove 10. These bars 14 are spaced apart in order to provide lateral flexibility to the hand. The bars 14 are also placed generally parallel to the fingers and bones of the hand to further facilitate natural movement of the hand. The bars 14 are permanently mounted in the glove material to prevent them from becoming loose objects which might dislodge during an exercise activity. The bars 14 are also flat in shape so that the glove 10 maintains a smooth outer contour, and such weighted bars cannot be used as weapons by a wearer of the glove 10.

Each finger sleeve 16 and thumb sleeve 18 is individually separated to provide maximum flexibility of the phalanges. The example sleeves are also cutoff to allow exposure of the fingertips past the first knuckle of each digit to aid in usability of the gloves while performing other tasks. At the end of each sleeve 16, 18 a semicircular weight 20 is incorporated into each side. The weights 20 are tapered on the sides to allow adjacent fingers to rest next to each other without undue separation. Each weight is shaped and sized accordingly in order to accommodate the different sized digits of the hand. As before, the finger weights 20 will be permanently incorporated into the material comprising the glove so that the weights cannot be dislodged. Also, the weights are strategically placed so as to minimize or eliminate their possible use as weapon.

A strap 22 wraps around the wrist and has a flat or deformable weight incorporated into the strap material. The strap 22 wraps all the way around the wrist in order to provide maximum support. The strap 22 is secured in place by snap 24 in the wrist band material and a receptacle in the glove and/or hook-and-pile attachment material 23 around the ends of the strap.

Figure 3:
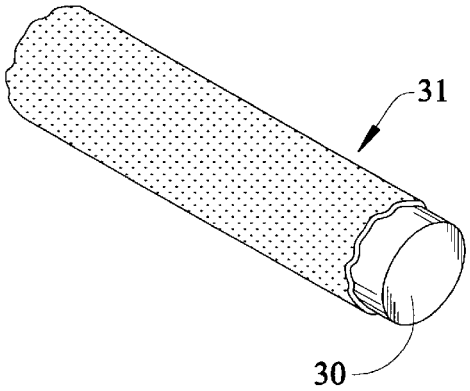
FIG. 3 illustrates a hook-and-pile covered cylindrical weight which is attached to the hook-and-pile strip on the palm of the glove of FIG. 2.
Figure 2:
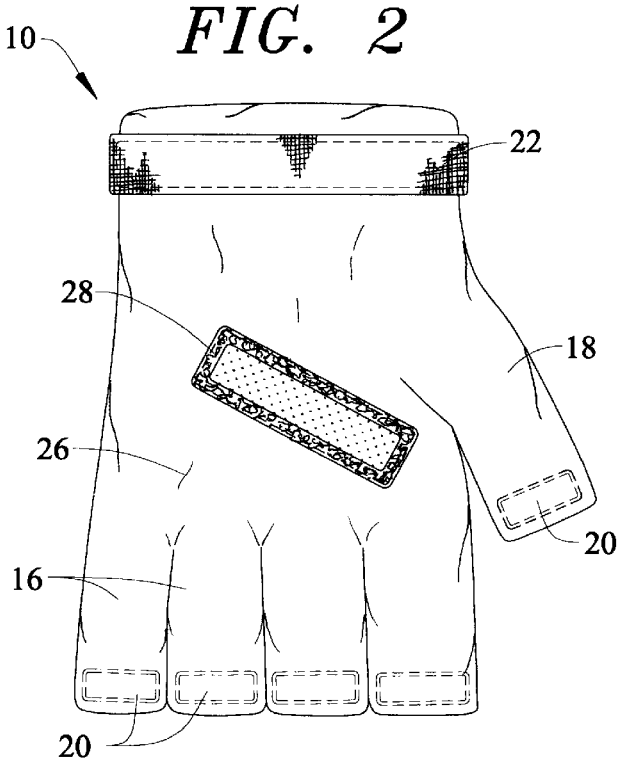
FIG. 2 shows a bottom view of the palm side of a weighted glove with the incorporated weight sections shown in fathom.

Referring now to FIG. 2, a bottom view of the palm side 26 of the glove 10 is shown. A second set of semicircular finger weights 20 are shown mounted on the palm side 26 of the finger and thumb sleeves 16 and 18. A hook-and-pile attachment strip 28 is mounted on the palm of the hand. With further reference to FIG. 2, the attachment strip 28 is angled in order to facilitate gripping of the weight 30. Referring also to FIG. 3, a cylindrical weight 30 is shown which is covered with corresponding hook-and-pile attachment material 31. The weight 30 can thereby be grasped by the wearer of the gloves and the weight will detachably stick to the strip 28. This allows the user to benefit from increased overall weight being added to the glove, but allows the user to lightly grip in order to keep the weight in place. The weight 30 can also be swapped out very quickly to a higher or lower resistance as needed. The user may choose not to use the auxiliary weight 30 for many activities such as swimming or basketball where the weight would interfere with the sporting activity.

The palm side 26 of the glove 10 might also include rubberized strips around the palm and digits to assist in gripping the auxiliary weight 30, or other such objects. The weighted band 22 is also shown to extend around the palm side 26 of the wrist.

Figure 4:
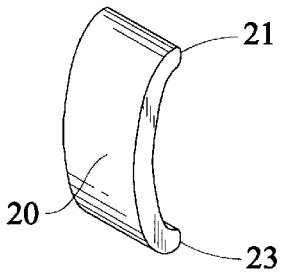
FIG. 4 shows a perspective view of a weight incorporated into each finger sleeve.

Referring now to FIG. 4, a cross-sectional embodiment of the contoured finger weight 20 is shown. As stated above, the weight 20 tapers at each end 21 and 23 in order to allow unimpeded adjacent positioning of the fingers. Generally, the preferred embodiment of the glove would weigh approximately one pound, with the weight distributed proportionately across the back-hand, finger, and thumb weights. The weighted gloves could be constructed with various poundages according to the user's needs. Extra weight might additionally be added by the grasping of a palm weight 30. The individual weights affixed inside and/or under the material of the glove would be made from such materials as lead or heavy metal as needed to achieve the desired volumetric density. Such weights would be coated with plastic or rubber in order to make them smooth and waterproof. The gloves might then be used for water activities or cleaned when necessary.

The weights 20 on the end of each finger provide gravity resistance for exercising individual fingers of the hand. Such exercise or rehabilitation might be performed with the assistance of the gloves alone, or in combination with wearing the gloves while performing other activities including but not limited to aerobics, jogging, and/or swimming. Accordingly, these gloves will provide an exercise and rehabilitative device which can conveniently be used to strengthen the fingers and the hand while allowing the user to perform other activities.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and descriptions.

What is claimed is:

1. An exercise and rehabilitation device comprising:

a glove having individual finger sleeves and a thumb sleeve, said glove having a back-hand side and a palm side;

at least one weight bar affixed to said back-hand side;

a first plurality of contoured weights operatively paired with a second plurality of contoured weights to thereby encircle each fingered sleeve and thumb sleeve, each of said weights having ends tapered to facilitate natural spacing between fingers placed within said fingered sleeves, thereby allowing said fingers to form a fist;

a hook-and-pile attachment strip on said palm side of said glove, and a corresponding hook-and-pile covered cylindrical weight which is detachably secured to said strip; and a securing strap including a flexible weight member, said flexible weight member sized to selectively encircle an individual's wrist, said weight member allowing said securing strap to be placed alternately in an glove-securing orientation or a glove-removal orientation.

2. The exercise and rehabilitation device of claim 1, wherein a plurality of weight bars are spaced apart across said back-hand side of said glove, said bars affixed generally parallel with said fingers.

3. The exercise and rehabilitation device of claim 1, wherein said finger and thumb sleeves terminate to expose the ends of each finger of the user.

4. The exercise and rehabilitation device of claim 3, wherein said contoured weights are located at the ends of said terminated sleeves near the end knuckle of each digit.

5. The exercise and rehabilitation device of claim 1, wherein said weighted wrist strap is attachable secured with both a snap and hook-and-pile attachment material.

6. The exercise and rehabilitation device of claim 1, wherein said hook-and-pile attachment strip on said palm side angles upwards between the thumb and index finger to facilitate easier gripping of said hook-and-pile cylindrical weight.

* * * * *